US007294795B1

(12) United States Patent
Kondo et al.

(10) Patent No.: US 7,294,795 B1
(45) Date of Patent: Nov. 13, 2007

(54) SLIDE SWITCH

(75) Inventors: Hayato Kondo, Yao (JP); Takayuki Nagata, Yao (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 11/656,703

(22) Filed: Jan. 23, 2007

(30) Foreign Application Priority Data

Jan. 25, 2006 (JP) ..... 2006-016393

(51) Int. Cl.
*H01H 9/00* (2006.01)

(52) U.S. Cl. ..... 200/5 R; 200/6 A

(58) Field of Classification Search ..... 200/5 R, 200/6 A, 17 R, 18, 329; 341/20, 22, 35; 345/156, 157, 160, 161, 163, 167, 168, 169, 345/184, 172

See application file for complete search history.

(56) References Cited

U.S. PATENT DOCUMENTS

| | | | | |
|---|---|---|---|---|
| 5,012,230 | A * | 4/1991 | Yasuda | 345/160 |
| 5,327,162 | A * | 7/1994 | Soma | 345/161 |
| 6,528,740 | B2 * | 3/2003 | Miyoshi | 200/5 R |
| 6,608,263 | B2 * | 8/2003 | Myojin | 200/16 D |
| 6,657,141 | B1 * | 12/2003 | Myojin | 200/6 A |
| 6,689,967 | B2 * | 2/2004 | Myojin | 200/18 |
| 6,700,565 | B2 * | 3/2004 | Niiyama | 345/172 |
| 6,831,238 | B1 * | 12/2004 | Lau | 200/6 A |
| 7,068,259 | B2 * | 6/2006 | Kim et al. | 345/169 |
| 2005/0000783 | A1 | 1/2005 | Nishimura et al. | |

FOREIGN PATENT DOCUMENTS

| | | |
|---|---|---|
| EP | 1 202 311 | 5/2002 |
| GB | 2 376 345 | 12/2002 |
| JP | 2003-031076 | 1/2003 |
| JP | 2003-050667 | 2/2003 |

* cited by examiner

*Primary Examiner*—Michael A Friedhofer
(74) *Attorney, Agent, or Firm*—The Webb Law Firm

(57) ABSTRACT

A slide switch includes a disk-shaped control member laid over a support member accommodated in a casing, a plurality of transverse contacts arranged in positions to surround the control member, and an annular vertical contact arranged outwardly of the transverse contacts to detect a sliding operation of the control member. Rod-shaped guide elements formed on peripheries of the support member are fitted into concaved engageable portions formed in the casing to be relatively movable in the pressing direction when the control member is pressed. The engageable portions and the guide elements constitute a posture maintaining mechanism.

9 Claims, 11 Drawing Sheets

SLIDE SWITCH

BACKGROUND OF THE INVENTION

1. Field of the Invention

The present invention relates to a slide switch comprising a control member slidable along an imaginary plane and pressable in a direction perpendicular to the imaginary plane, a plurality of transverse contacts arranged to surround the control member, and a vertical contact having a plurality of electrode portions associated with the plurality of transverse contacts to be conductive with any one of the transverse contacts when the control member is slid.

2. Description of the Related Art

Japanese Patent Application "Kokai" No. 2003-31076 (paragraphs [0022] to [0038], and FIGS. 2 to 6) discloses a slide switch including an biasing member formed of elastomer, having four projections, and mounted in a casing, a sliding member fitted into a central portion of the biasing member, and a keytop connected to the sliding member. In this slide switch, four conductive elements are provided on outer peripheries of the biasing member while electrodes are arranged on inner walls of the casing in positions opposed to the conductive elements. With this arrangement, the keytop in a non-operative state is maintained in a neutral position by a biasing force exerted from the biasing member, and the conductive elements contact the electrodes to establish a conductive state when the keytop is operated. Also, this switch has a slider fitted into a side of the sliding member facing away from the keytop. The conductive elements are arranged in positions to contact the slider, and the electrodes are arranged in positions corresponding to the conductive elements. Each conductive element has a construction having a central portion projecting toward the slider. When the keytop is depressed, the conductive element is elastically deformed to contact the electrode thereby establishing a conductive state.

Japanese Patent Application "Kokai" No. 2003-50667 (paragraphs [0012] to [0026], and FIGS. 1 to 7) discloses a slide switch comprising a spacer, a control button, a return spring, a plunger, a sensing spring and a reverse spring laid one over another in a space between a base and a cover. In this slide switch, a knob of the control button projects to a center hole formed in the cover, and a biasing force is exerted on the control button from the return spring. A conductive rubber element is attached to a bottom surface of the control button, and guide projections are formed in a central portion of the bottom surface of the control button to be engageable with guide recesses formed in a top surface of the plunger. The guide recesses of the plunger are formed as grooves radially extending in eight directions from the center of the plunger. The plunger has a pressing projection formed in a bottom surface thereof, and an engaging projection formed in outer peripheries thereof to be engageable with the base for limiting rotation. The base has a central fixed contact provided in a circular recess formed in a central portion thereof, and peripheral fixed contacts formed in outer peripheries of the circular recess. The reverse spring and the sensing spring are arranged as corresponding to the circular recess.

With the construction of this conventional slide switch, the guide projections formed in the bottom surface of the control button are guided by the guide recesses of the plunger when the control button is slid, thereby allowing the button to be operated in eight directions. This sliding operation allows the conductive rubber element attached to the bottom surface of the control button to contact the peripheral vertical contacts of the base, thereby to electrically detect an operating direction. Further, when the control button is pressed while being slid, this operating force is transmitted to the reverse spring through the plunger. The central portion of the reverse spring contacts the central vertical contact thereby to electrically detect the pressing operation.

Recently, as switches provided in relatively small devices such as mobile phones, PDA's, game equipment controllers and remote controllers, and the like, high-performance switches capable of being slid and pressed such as the slide switches disclosed in the above-noted publications have been desired, along with their downsizing. Further, from the aspect of the sense of operation, the sense of click and a smooth sliding operation are often desired. Also, in executing the sliding operation and the pressing operation at the same time, the sense of operation is enhanced by stabilizing the posture of the control member when pressed.

According to the slide switches disclosed in the above-noted publications where the control member in a non-operative state is positioned in the central position in plan view, the contacts for detecting a pressing operation of the control member and the springs for biasing the control member upward are located in the central position. Thus, the pressing force acts upon a position offset from the central position when the control member is pressed while being slid. The control member is inclined by the force unevenly applied to the control member to vary the stroke of the pressing operation and weaken the sense of operation. Further, the inclination of the control member causes malfunction.

Moreover, in the case of a switch using a member having a dome-shaped construction as a spring for biasing the control member upward, when the control member is pressed while being slid, the pressing force acts on a position offset from the central position of the dome, as a result of which the life of the dome-shaped spring is shortened.

SUMMARY OF THE INVENTION

The object of the present invention is to provide a slide switch with a rational construction capable of realizing a smooth operation when the control member is pressed while being slid.

In order to achieve the above-noted object, the present invention provides a slide switch comprising a control member slidable in a direction along an imaginary plane and pressable in a direction perpendicular to the imaginary plane, a plurality of transverse contacts arranged to surround the control member, and a vertical contact having a plurality of electrode portions associated with the plurality of transverse contacts to be conductive with any one of the transverse contacts when the control member is slid, in which the switch further comprises a support member for contacting a sliding surface formed on a surface facing away from a control surface of the control member to allow the sliding movement of the control member, a casing for accommodating the support member and control member so that the members are movable in unison in the pressing direction, and a posture maintaining mechanism for maintaining a relative position between the control member and the casing when the control member and the casing are moved in the pressing direction, the posture maintaining mechanism being provided between the control member and the casing.

In a sliding operation using the control member, the control member is slid with the sliding surface of the control member contacting the support member to exert a pressing force from the control member on any one of the plurality of transverse contacts. The transverse contact contacts the vertical contact thereby to electrically detect the direction of the sliding operation. When the control member is pressed while being slid, a pressing force acts on a position offset from the central portion of the casing. At that time, the posture maintaining mechanism maintains the position, relative to the casing, of the support member contacting the control member. Thus, an inclination of the support member is restrained, and the support member and control member make a parallel movement in the pressing direction. As a result, a smooth operation is realized even when the control member is pressed while being slid.

According to one of the preferred embodiments of the invention, the casing includes an opening formed in a central portion of a top surface thereof, and the control member has an integral construction including a control portion projecting upward from the opening and a flange portion formed peripherally of a bottom surface of the control member, the support member having a larger diameter than the flange portion, and the posture maintaining mechanism includes guide elements formed on outer peripheries of the support member to extend along the pressing direction, and engageable portions formed in the casing to be engageable with the guide elements, the engageable portions allowing sliding movement of the guide elements in the pressing direction. With this construction, when the control member is pressed, the guide elements formed on the outer peripheries of the support member are slid relative to the engageable portions of the casing. As a result, the control member and support member make a parallel movement in unison in the pressing direction relative to the casing to avoid inclination of the control member.

According to another preferred embodiment, the casing includes an opening formed in a central portion of a top surface thereof, and the control member has an integral construction including a control portion projecting upward from the opening and a flange portion formed peripherally of a bottom surface of the control member, the support member having a larger diameter than the flange portion, and the posture maintaining mechanism includes guide elements formed in the casing to extend along the pressing direction, and engageable portions formed in outer peripheries of the support member to be engageable with the guide elements, the guide elements allowing sliding movement of the engageable portions in the pressing direction. With this construction, when the control member is pressed, the engageable portions formed in the outer peripheries of the support member are slid relative to the guide elements formed in the casing. As a result, the control member and support member make a parallel movement in unison in the pressing direction relative to the casing to avoid inclination of the control member.

According to a further preferred embodiment, the vertical contact is arranged to have an annular conductor surrounding the plurality of transverse contacts, and a plurality of biasing pieces are provided to project from the vertical contact toward the bottom surface of the support member to act as an biasing mechanism for exerting an biasing force on the support member counter to the pressing direction. With this construction, the vertical contact is formed as the annular member to act as a common contact, and thus the inner surface of the annular vertical contact contacts the transverse contacts to produce a conductive state, instead of using a plurality of vertical contacts corresponding to the plurality of transverse contacts. As a result, the sliding operation of the control member can be detected. Also, since the plurality of biasing pieces formed on the vertical contact are used as the biasing mechanism, the biasing force is exerted on the support member without using a coil spring or the like.

According to a still further embodiment, the vertical contact is supportably fitted into the bottom surface of the casing and includes conductive electrode portions extending downward from the vertical contact. With this construction, it is easy to apply a voltage to the annular member through the conductive electrode portions extending downward from the annular member, with the annular member being supportably fitted into the bottom surface of the casing, or to earth the annular member (to bring the voltage to a ground level).

According to a still further embodiment, the transverse contacts are supportably fitted into the bottom surface of the casing and include conductive electrode portions extending downward from the transverse contacts. With this construction, it is possible to recognize the sliding direction of the control member from a conductive state between the transverse contacts and the vertical contact through the electrode portions of the transverse contacts, with the plurality of transverse contacts being supportably fitted into the bottom surface of the casing.

Other features and advantages of the present invention will be apparent from the description of embodiments in reference to the accompanying drawings.

DESCRIPTION OF THE PREFERRED EMBODIMENTS

Figure 1:
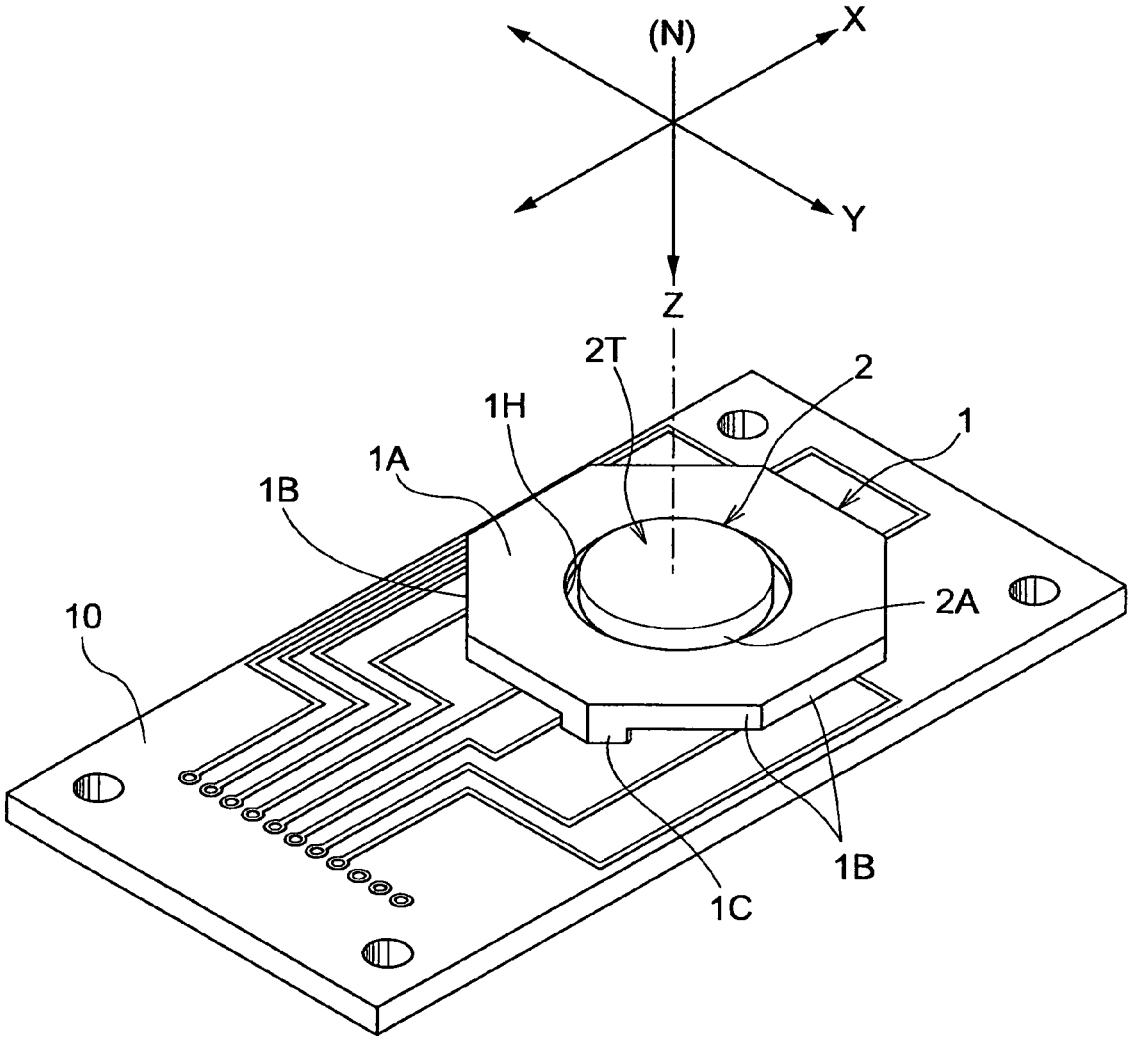
FIG. 1 is a perspective view showing a slide switch mounted on a substrate.

Embodiments of the present invention will be described hereinafter with reference to the accompanying drawings.

As shown in FIGS. 1 to 4, a slide switch comprises a regular octagonal casing 1 having a circular opening 1H formed in a central portion thereof to vertically extend therethrough, a disk-shaped control member 2 accommodated in the casing 1, a plate-shaped regular octagonal support member 3 accommodated in the casing 1 as placed in contact with the control member 2, eight transverse contacts 4 supported by the casing 1 in positions to surround the control member 2, a vertical contact 5 in the form of an annular element disposed in a position to surround the eight transverse contacts 4, a posture maintaining mechanism A for realizing a vertical parallel movement of the control member 2 and support member 3 laid one over the other when the control member 2 is pressed, a biasing mechanism B for exerting a biasing force in a direction to push back the support member 3, and an operation detecting mechanism C assuming a detecting state in response to pressure received from the support member 3 when the control member 2 is pressed. As described in detail below, the biasing mechanism B is realized by elements constituting the vertical contact 5.

Figure 2:
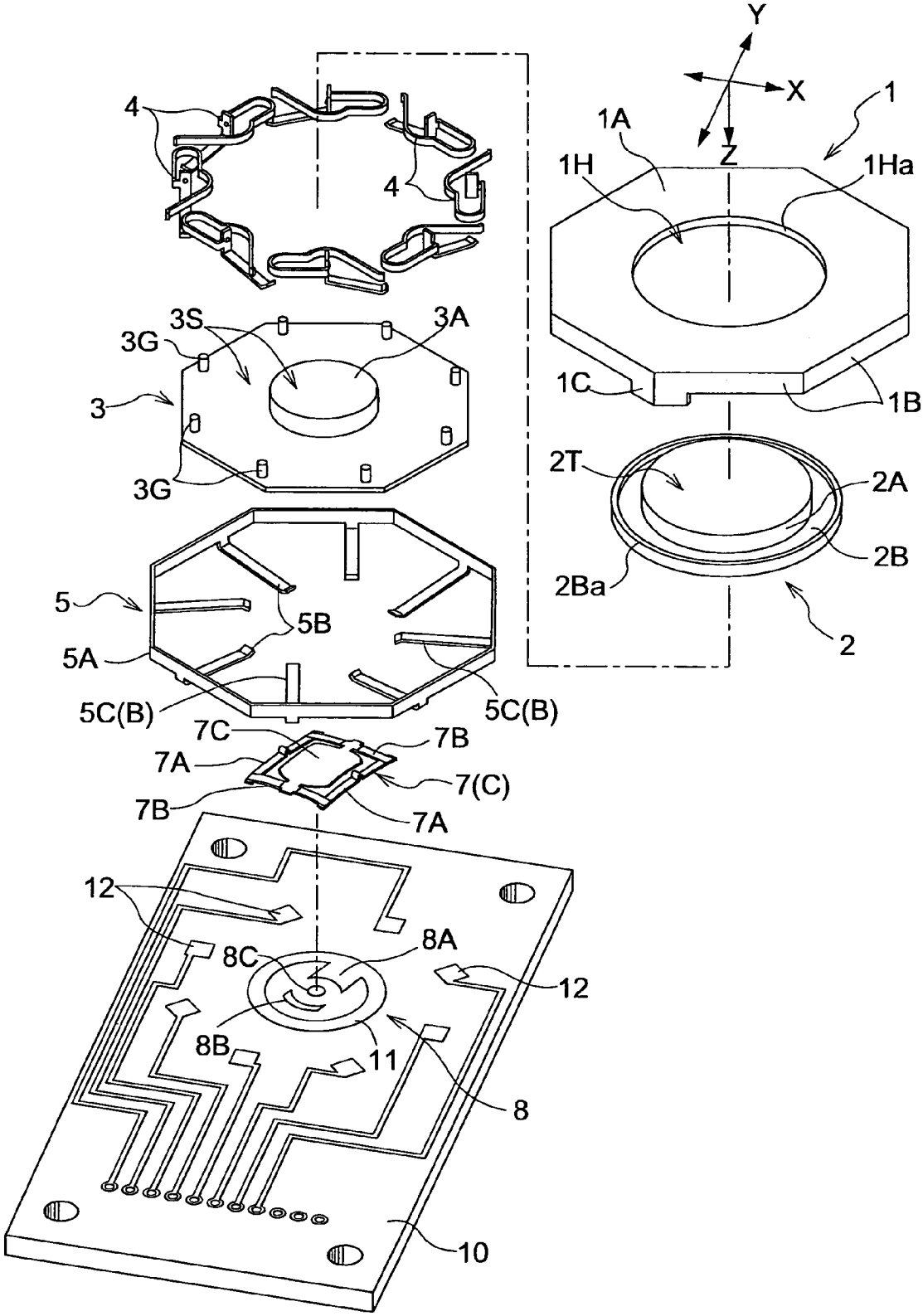
FIG. 2 is a perspective view showing the substrate and the slide switch in an exploded state.
Figure 3:
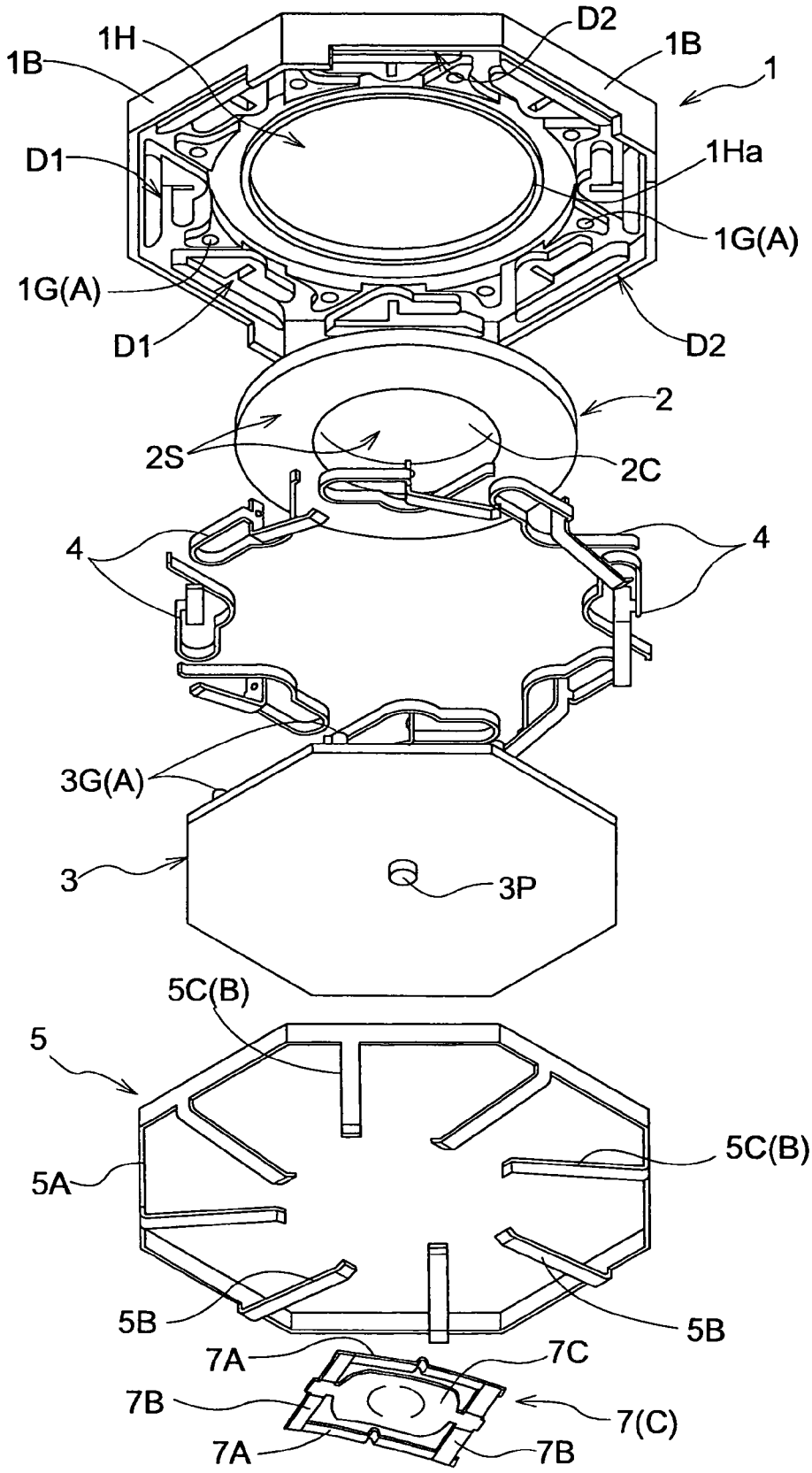
FIG. 3 is an exploded perspective view of the slide switch.
Figure 4:
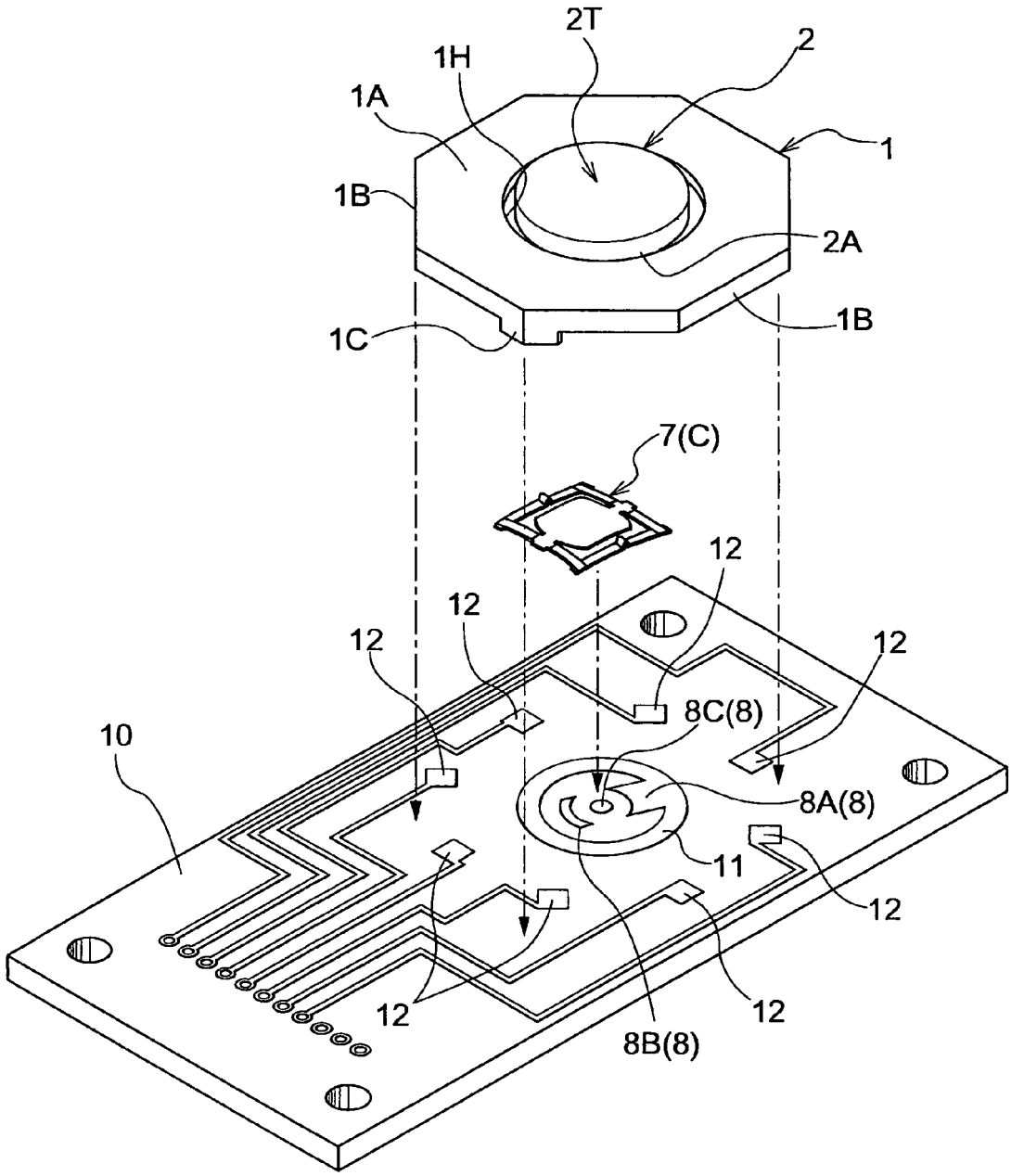
FIG. 4 is a perspective view showing the slide switch separated from the substrate.

This slide switch is incorporated into a mobile phone, a PDA, a controller for game equipment, a remote controller for a home electrical appliance or the like, and has a function for detecting a sliding operation of the control member 2 and a pressing operation of the control member 2.

Where an X-Y direction is defined as a direction of an imaginary plane (a horizontal surface of a substrate 10 in this embodiment) along which the control member 2 is slidable, a direction for the pressing operation may be defined as a Z direction perpendicular to the imaginary plane. While the vertical direction is irrelevant in using the slide switch, an upper position in the Z direction in FIGS. 1 and 2 is called the upper side for expediency.

In this slide switch, the operation detecting mechanism C is placed on the substrate 10. The casing 1 having the control member 2 and support member 3 is attached to the substrate 10 to cover the operation detecting mechanism C. However, the operation detecting mechanism C may be supported by a bottom portion of the casing 1.

Figure 7:
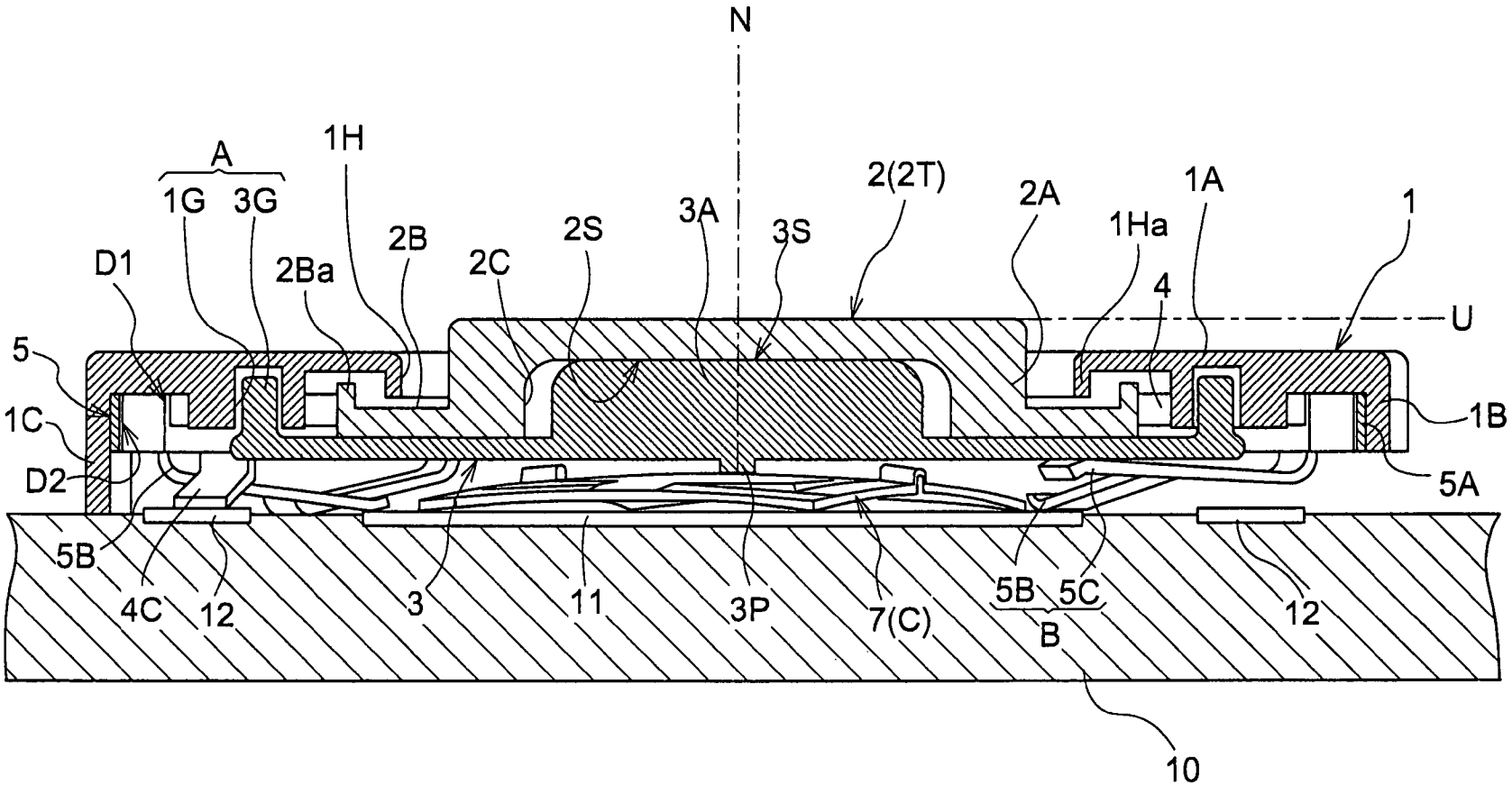
FIG. 7 is a sectional view of the slide switch supported by the substrate.

In a non-operative state of the slide switch, the control member 2 is maintained in a neutral position N in the X-Y direction by an biasing force exerted from the eight transverse contacts 4 (see FIG. 9A), and at the same time a control surface 2T of the control member 2 is maintained in a non-operative position U in the Z direction by a biasing force exerted from the biasing mechanism B (see FIG. 7).

Figure 5:
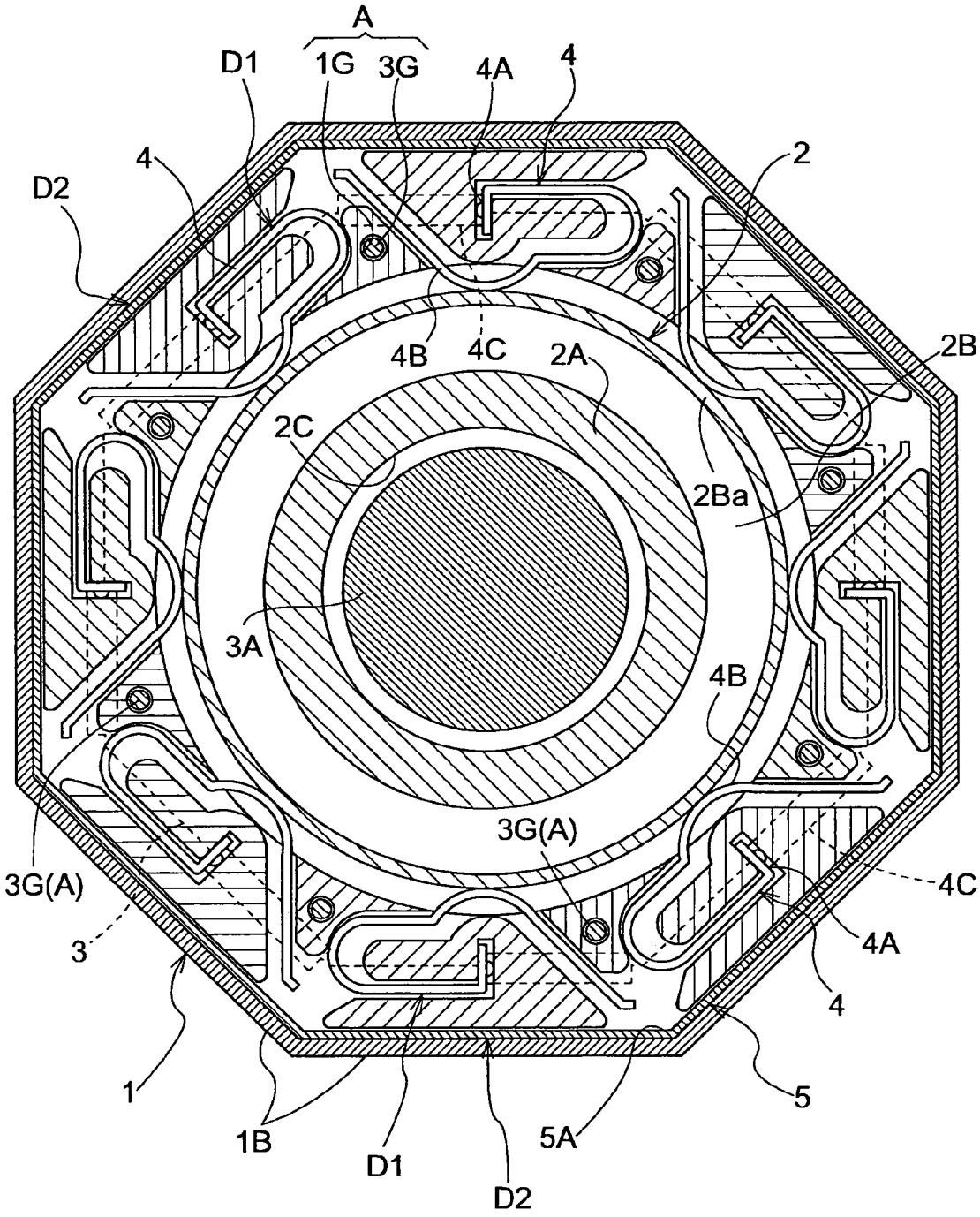
FIG. 5 is a cross sectional plan view of the slide switch.
Figure 6:
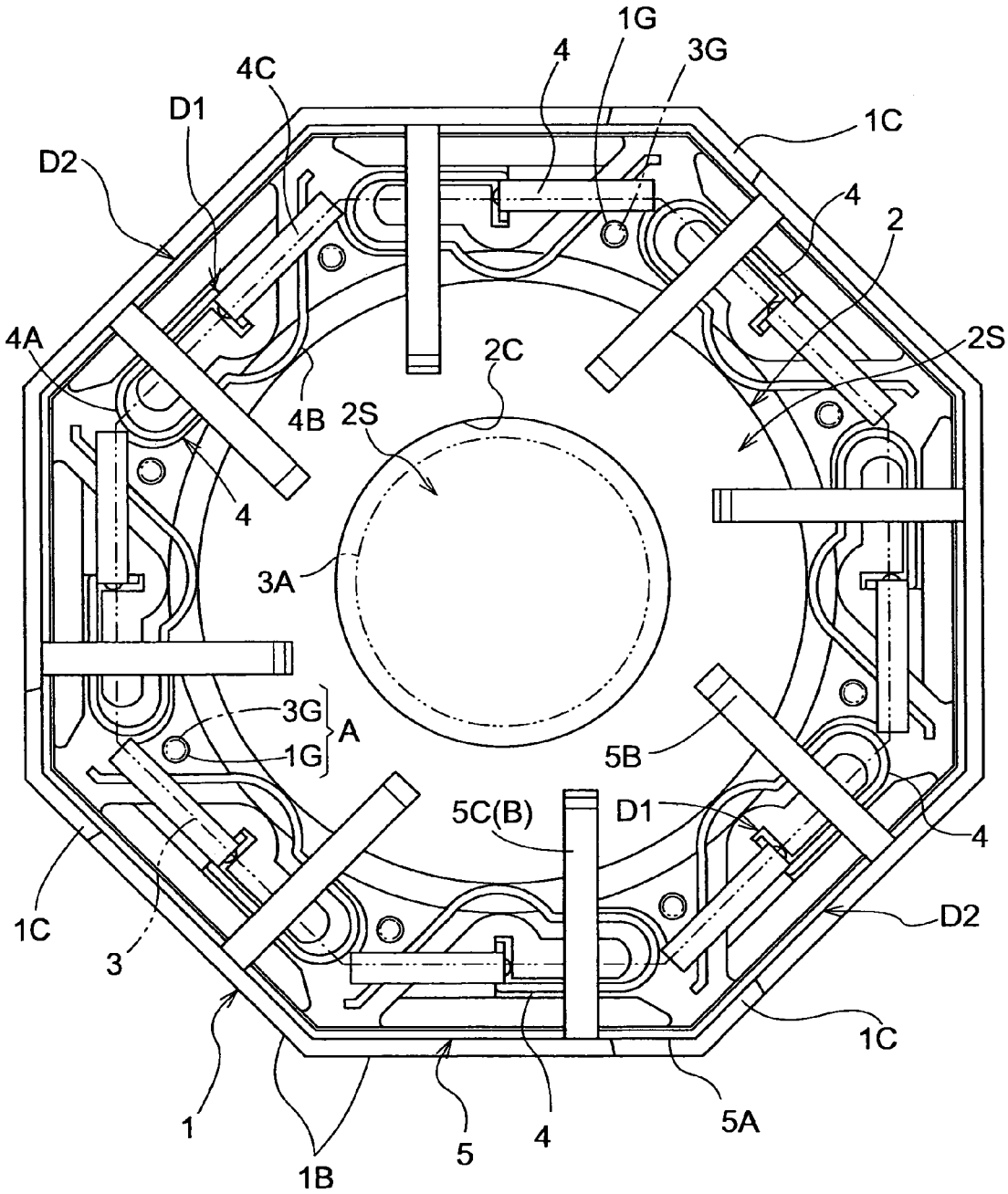
FIG. 6 is a bottom view of the slide switch.

The casing 1 is formed of an insulating plastic material and includes a flat upper wall 1A, eight side walls 1B and positioning projections 1C provided on outer bottom portions of the side walls 1B. As shown in FIGS. 5 to 7, the circular opening 1H is formed in the upper wall 1A, and a member defining an opening edge projects downward to form an opening wall portion 1Ha. In the bottom of the casing 1 are formed eight first engageable grooves D1 into which the transverse contacts 4 are fitted, an annular second engageable groove D2 into which the vertical contact 5 is fitted, and eight engageable portions 1G recessed along the Z direction to receive eight guide elements 3G formed on the support member 3.

The control member 2 is formed of an insulating plastic material and includes a control portion 2A projecting upward and having a smaller diameter than the opening 1H of the casing 1, a flange portion 2B formed peripherally of the bottom of the control portion 2A and having a larger diameter than the opening 1H of the casing 1, a recess 2C formed in the bottom of the control portion 2A and having a circular shape in plan view, and an annular peripheral wall portion 2Ba extending upward from outer peripheries of the flange portion 2B.

The control surface 2T contacted by a finger of the operator is formed on a top surface of the control portion 2A of the control member 2. Sliding surfaces 2S are formed on the bottom surface of the flange portion 2B and the bottom surface of the recess 2C, respectively.

The support member 3 has an octagonal shape having a slightly larger diameter than the flange portion 2B, and includes a projection 3A having a circular shape in plan view and formed in a central portion of the top surface of the support member to be fitted into the recess 2C of the control member 2. A flat supporting surface 3S is formed in a portion surrounding the projection 3A. A boss 3P is formed in a central portion of the bottom surface. The eight guide elements 3G are formed in radially outward positions on the supporting surface 3S, and have a rod-like shape extending upward.

The recess 2C of the control member 2 has a diameter (inside diameter) large than the diameter (outside diameter) of the projection 3A of the support member 3. The peripheral wall portion 2Ba formed on the flange portion 2B of the control member 2 has a diameter (inside diameter) larger than the diameter (outside diameter) of the opening wall portion 1Ha formed on the casing 1. Thus, the control member 2 is allowed to slide relative to the support member 3.

In this slide switch, the top surface of the projection 3A of the support member 3 contacts the sliding surface 2S formed on the bottom surface of the recess 2C of the control member 2, and the supporting surface 3S of the support member 3 contacts the sliding surface 2S formed on the bottom surface of the flange portion 2B of the control member 2, thereby allowing the sliding operation of the control member 2. In the present invention, only one of the sliding surface 2S formed on the bottom surface of the recess 2C of the control member 2 and the sliding surface 2S formed on the bottom surface of the flange portion 2B of the control member 2 may act as the sliding surface 2S.

The eight guide elements 3G provided peripherally of the supporting surface 3S of the support member 3 are arranged in positions not to contact the flange portion 2B of the control member 2 when the control member 2 slides. The guiding direction of these eight guide elements 3G is the vertical direction parallel to the Z direction.

When the control member 2 is pressed, the control member 2 and support member 3 are vertically moved in unison. At this time, the eight engageable portions (holes) 1G formed in the casing 1 and the eight guide elements 3G fitted into the engageable portions 1G maintain an engaged condition, thereby to avoid a drawback of allowing the control member 2 and support member 3 to incline relative to the casing 1. The eight engageable portions 1G formed in the casing 1 constitute the posture maintaining mechanism A with the guide elements 13G.

The control member 2 slides with the lower sliding surface 2S of the control member 2 in contact with the supporting surface 3S formed on the top surface of the support member 3. To this end, the supporting surface 3S and the sliding surface 2S have flat and smooth finished surfaces. As an alternative to the above, another embodiment may be proposed in which fine projections are formed in one of the supporting surface 3S and sliding surface 2S, for example, to avoid a tight-contact condition.

Figure 8:
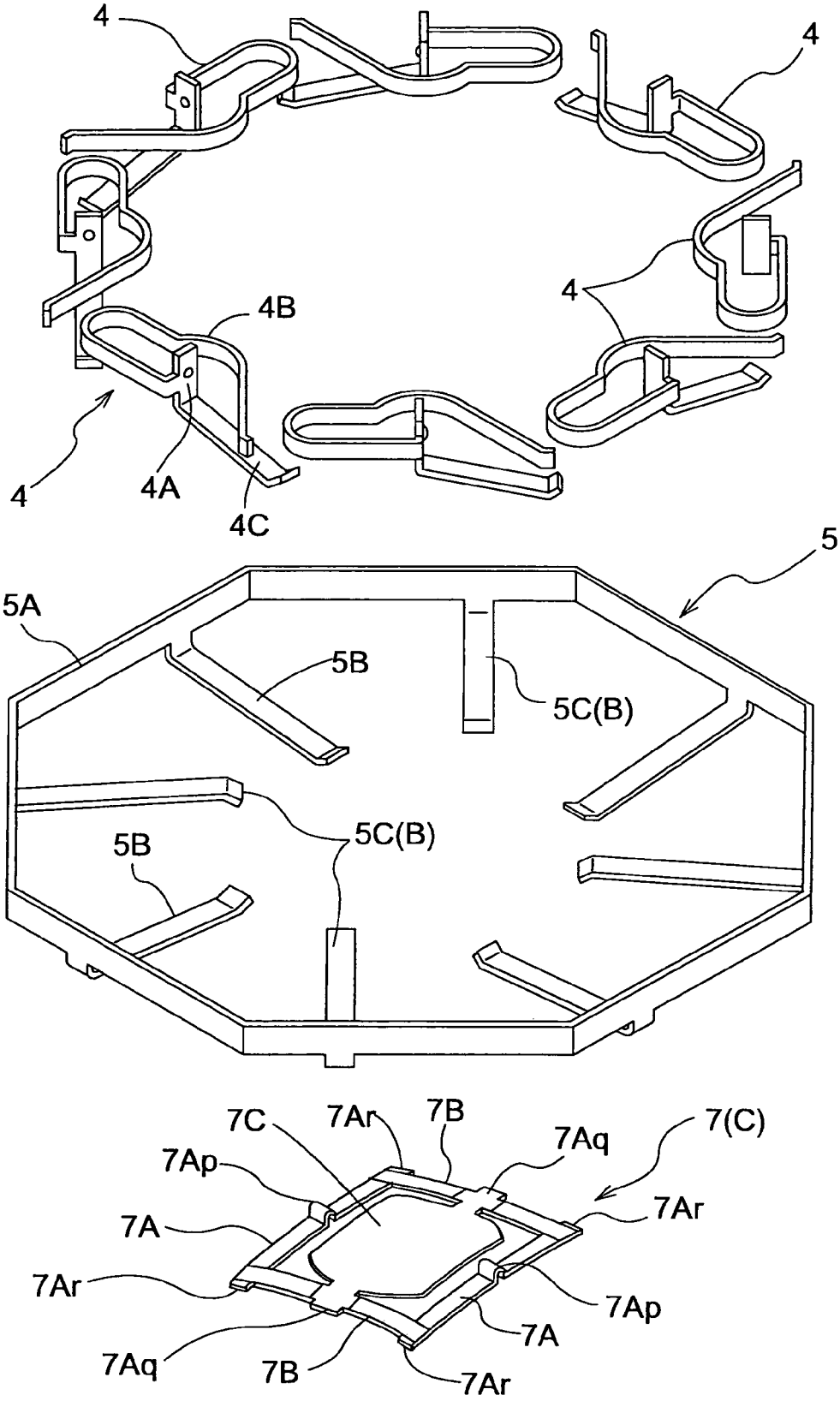
FIG. 8 is a perspective view showing transverse contacts, a vertical contact and an elastic contact.

As shown in FIG. 8, each of the transverse contacts 4 has an integral construction using a spring plate material made of flexibly and elastically deformable copper alloy and including a linear proximal end portion 4A, a contact portion 4B bulging and curving sideways from the proximal end portion 4, and an electrode portion 4C extending obliquely downward from a lower end of the proximal end portion 4A.

The transverse contacts 4 are supported with the proximal end portions 4A fitted into the first engageable grooves D1 formed in the casing 1. When the control member 2 is in the non-operative condition in the slidably operating direction, curved portions of the contact portions B of the plurality of transverse contacts 4 lightly contact the outer peripheries of the flange portion 2B of the control member 2 to maintain the control member 2 in the neutral position N.

The vertical contact 5 has an integral construction using a copper alloy material and including an annular portion 5A having an octagonal shape in plan view, a plurality of electrode portions 5B projecting obliquely downward from lower edges of the annular portion 5A, a plurality of biasing pieces 5C projecting obliquely upward from lower edges of the annular portion 5A. The plurality of biasing pieces 5C constitute the biasing mechanism B.

The electrode portions 5B and biasing pieces 5C are formed by bending inward parts of the annular portion 5A. The annular portion 5A is supported as fitted into the second engageable groove D2 of the casing 1, whereby the respective sides of the octagonal annular portion 5A are opposed in outward positions thereof to the contact portions 4B of the transverse contacts 4. Further, the plurality of biasing pieces 5C contact the bottom surface of the support member 3 to exert an upward biasing force thereon. The biasing force is exerted in this way and acts upon the control member 2 through the support member 3, as a result of which the flange portion 2B of the control member 2 contacts the inner surface of the upper wall 1A of the casing 1 as shown in FIG. 7, thereby to maintain the control surface 2T of the control member 2 in the non-operative position U.

The vertical contact 5 functions as a common electrode. The shape of the vertical contact 5 is not limited to the regular octagon, but may be circular or a polygon having sixteen sides, for example. The vertical contact 5 may be an incomplete annular member having slit parts.

In particular, the vertical contact 5 produces a conductive state when distal ends of the contact portions 4B of the transverse contacts 4 contact inner surfaces of the annular portion 5A. In this contacting condition, an oxide or dust can be removed from the surface by wiping action of the contact portions 4B frictionally moving on the inner surfaces of the annular portion 5A.

The electrode portions 4C of the eight transverse contacts 4 and the four electrode portions 5B of the vertical contact 5 are arranged to contact wiring formed on the substrate 10 to produce a conductive state when the casing 1 is attached to the substrate 10.

As shown in FIG. 8, the operation detecting mechanism C includes an elastic contact 7 arranged on the substrate 10 and a fixed electrode 8 formed on the substrate 10, and acts as a push-on switch. More particularly, the elastic contact 7 includes a rectangular frame portion 7A made of an elastically and flexibly deformable copper alloy, and a curved spring plate portion 7C made of the elastically and flexibly deformable copper alloy and arranged in a space confined by the frame portion 7A. The spring plate portion 7C is structurally and electrically connected to the frame portion 7A through a pair of connecting portions 7B.

The frame portion 7A has four sides, two of which are longer than the remaining two sides. Each of the longer sides has a bent portion 7Ap formed in a longitudinally middle position thereof to protrude upward, while each of the shorter sides has a projecting piece 7Aq formed in a middle portion thereof to protrude outward. Projecting portions 7Ar are formed in the four corners of the frame portion 7A to project outward along the longer sides. It should be noted that the spring plate portion 7C forming the elastic contact 7 is not necessarily curved, but may maintain a flat configuration in the non-operative condition while becoming curved in time of operation.

The elastic contact 7 may be formed by press-working an elastically and flexibly deformable copper alloy plate. At that time, the frame portion 7A, connecting portions 7B and spring plate portion 7C are formed. The spring plate portion 7C has a central portion which is curved to gently bulge upward. The elastic contact 7 is formed to have an overall configuration with the central portion bulging upward, and thus the four projecting portions 7Ar and the two projecting pieces 7Aq contact the substrate 10 when the elastic contact 7 is mounted on the substrate 10. The elastic contact 7 may be formed of a plurality of elements connected to one another by spot-welding technique or the like.

As shown in FIG. 2, the fixed electrode 8 includes a first electrode portion 8A, a second electrode portion 8B and a third electrode portion 8C formed on the substrate 10 by printed wiring technique. A ring-shaped electrode 11 is formed in a position to surround the first electrode portion 8A, second electrode portion 8B and third electrode portion 8C. The first electrode portion 8A is formed conductive with the ring-shaped electrode portion 11. Further, the ring-shaped electrode portion 11 is disposed in a position to be conductive with the electrode portions 5B of the vertical contact 5.

The first electrode portion 8A and second electrode portion 8B are arranged to be spaced downward from the connecting portions 7B, and the third electrode portion 8C is arranged to be spaced downward from the central portion of the spring plate portion 7C. Though not shown in the drawings, wiring is formed on the substrate 10 to fetch a potential difference between the first electrode portion 8A, second electrode portion 8B and third electrode portion 8C (for distinguishing between conductive state and non-conductive state).

Figure 10A:
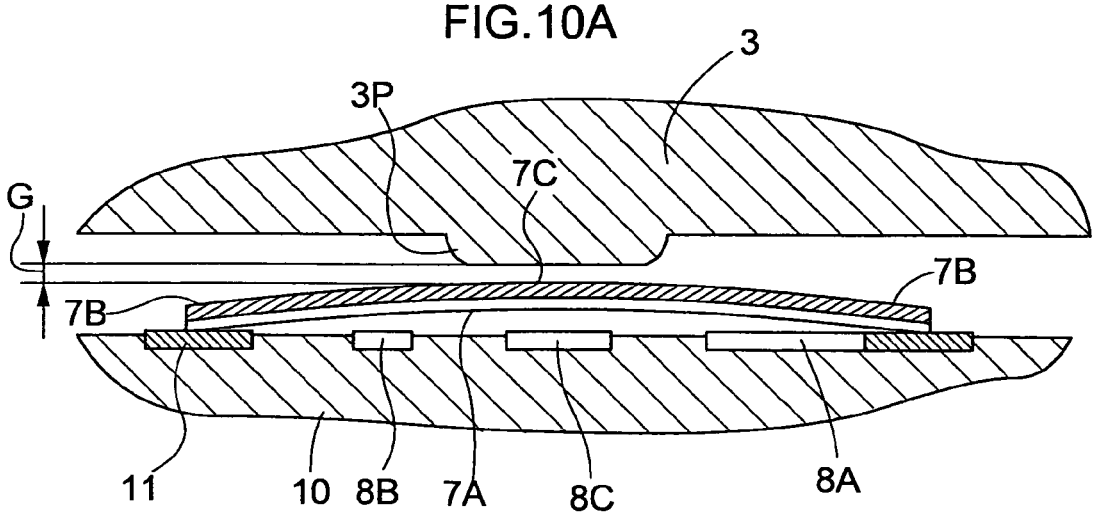
FIG. 10A is a perspective view of the elastic contact at start of a pressing operation.

As shown in FIGS. 7 and 10A, a relative positional relationship is established in which the lower surface of the boss 3P of the support member 3 is spaced from the central portion of the spring plate portion 7C by a distance G when the control member 2 is in the non-operative position U (where pressure is not exerted from the boss 3P of the support member 3).

Figure 10B:
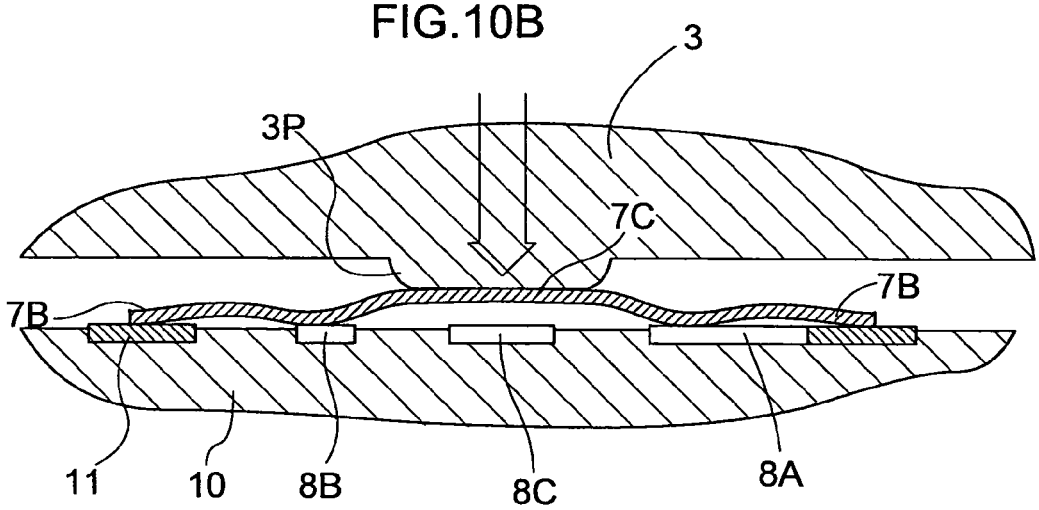
FIG. 10B is a perspective view of the elastic contact in the middle of the pressing operation.

On the other hand, as shown in FIG. 10B, when the control member 2 is pressed to exert pressure from the boss 3P of the support member 3 on the spring plate portion 7C, the spring plate portion 7C and connecting portions 7B start to be elastically deformed as a whole. Firstly, the pair of connecting portions 7B contact the corresponding first electrode portion 8A and second electrode portion 8B as shown in FIG. 10B, as a result of which the first electrode portion 8A and second electrode portion 8B become conductive.

Figure 10C:
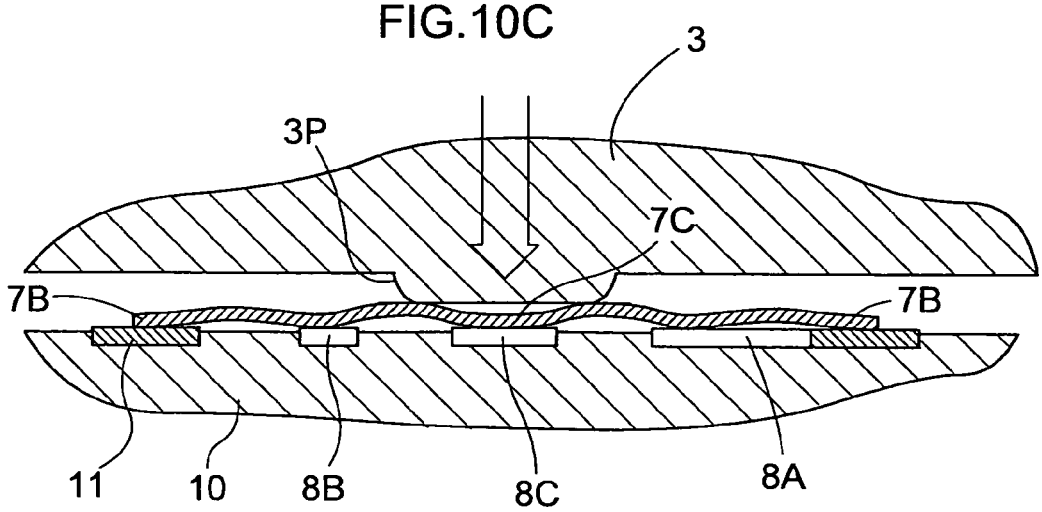
FIG. 10C is a perspective view of the elastic contact at the end of the pressing operation.

When the pressing operation is further continued, as shown in FIG. 10C, the central portion of the spring plate portion 7C contacts the third electrode portion 8C while the pair of connecting portions 7B remain in contact with the corresponding first electrode portion 8A and second electrode portion 8B. As a result, the first electrode portion 8A and third electrode portion 8C become conductive.

Thus, when the control member 2 is pressed, the pair of connecting portions 7B undergoes a change in posture to become parallel to the substrate 10, and subsequently the spring plate portion 7C is displaced toward the substrate 10. In time of the displacement, the spring plate portion 7C is elastically deformed to the extent that its bulging direction is reversed. As a result, not only is it possible to switch to a reliable conductive state by allowing the central portion of the spring plate portion 7C to contact the third electrode 8C by a resilient biasing force, but also an appropriate feel of clicking can be obtained. It is possible to recognize the conductive state from a relative potential between the first electrode portion 8A, second electrode portion 8B and third electrode portion 8C.

The substrate 10 includes eight independent electrodes 12 formed by printed wiring technique, and printed wiring is formed for fetching a potential from each independent electrode 12. In the state where the casing 1 is fixed to the substrate 10, the eight electrode portions 4C of the transverse contacts 4 contact the independent electrodes 12 thereby to produce a conductive state therebetween, while the electrode portions 5B of the vertical contact 5 contact the ring-shaped electrode 11 to produce a conductive state.

As noted above, the eight independent electrode portions 12 are allowed to contact the eight electrode portions 4C of the transverse contacts 4 to be electrically conductive with each other. Instead, these electrode portions may be made conductive with each other by soldering using a reflow technique or the like. In a similar manner, instead of allowing the electrode portions 5B of the vertical contact 5 to contact the ring-shaped electrode 11 to be electrically conductive with each other, these electrode portions may be made conductive with each other by soldering using the reflow technique or the like.

Figure 9A:
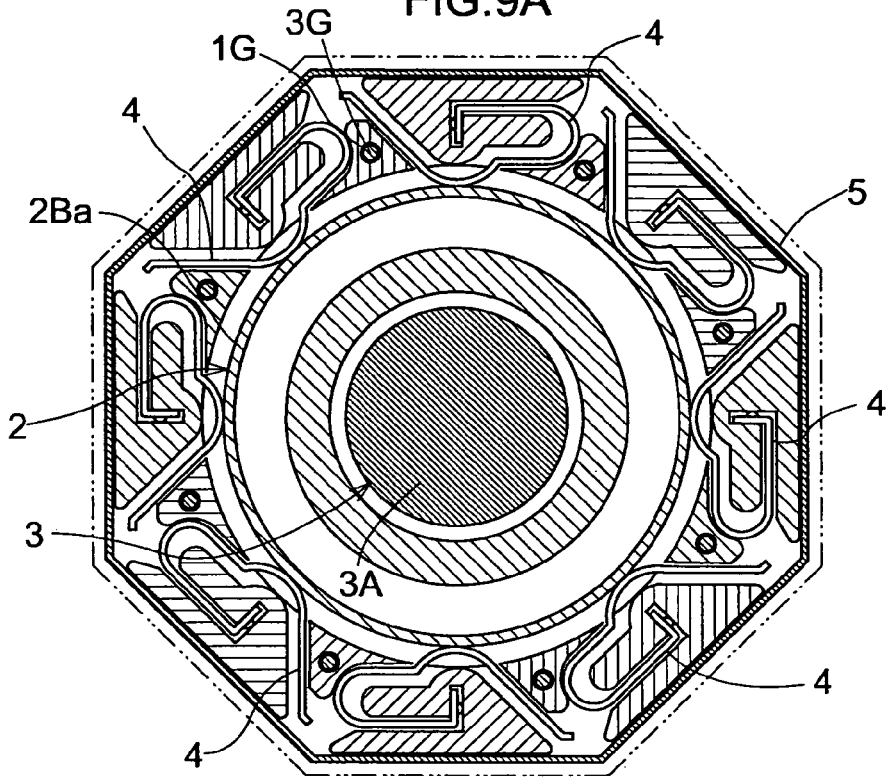
FIG. 9A is a sectional view of the slide switch in which a control member is in a non-operative state.
Figure 9B:
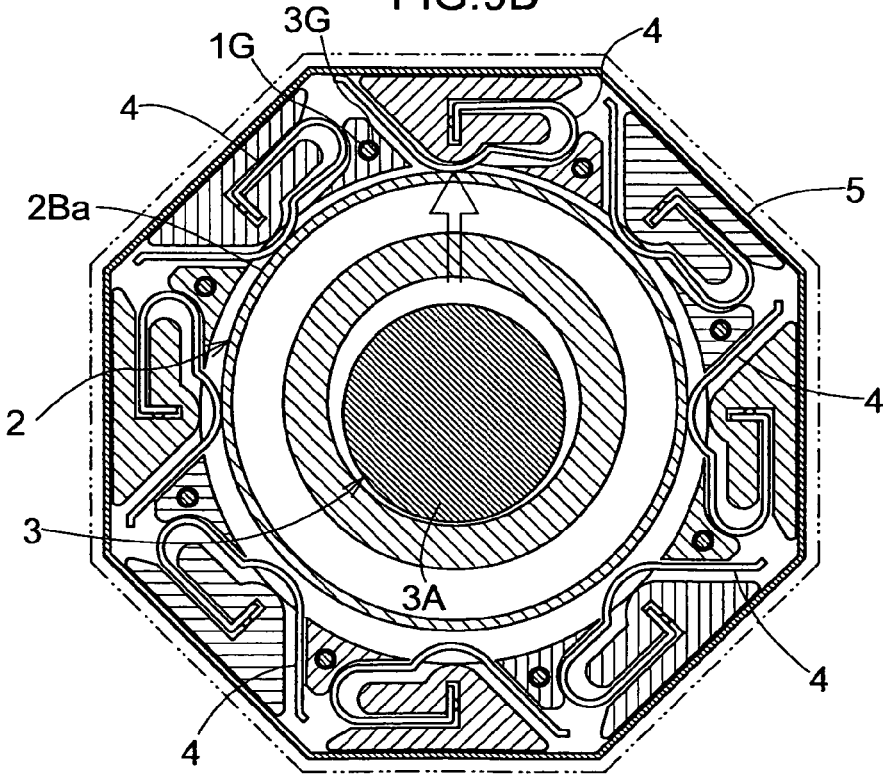
FIG. 9B is a sectional view of the slide switch in which the control member is in an operative state.

With the slide switch constructed in this way, when the control member 2 is in the non-operative condition, as shown in FIG. 9A, the control member 2 is maintained in the neutral position N by the biasing force exerted from the eight transverse contacts 4, and also maintained in the non-operative position U by the biasing force exerted from the plurality of biasing pieces 5C acting as the biasing mechanism B. When, in this state, the operator touches the control surface 2T of the control member 2 with his or her finger and slides the control member 2 on the plane along the X-Y direction, as shown in FIG. 9B, the transverse contacts 4 are elastically deformed by pressure from the flange portion 2B of the control member 2. As a result, the contact portions 4B contact the annular portion 5A of the vertical contact 5 thereby to produce the conductive state. This conductive state is electrically detected.

When the control member 2 is slid in an intermediate direction between two adjacent ones of the eight transverse contacts 4, the two transverse contacts 4 can concurrently contact corresponding parts of the annular portion 5A thereby to produce the conductive state. More particularly, the slide switch according to the present invention includes the eight transverse contacts 4, but can detect operations made in sixteen directions.

With this construction, when the control member 2 is operated to move the control member 2 in a direction along the inner peripheral edge of the opening 1H of the casing 1, any one of the contact portions 4B of the transverse contacts 4 having been in contact with the annular portion 5A of the vertical contact 5 maintains its contacting condition. In this condition, an adjacent one of the contact portions 4B of the transverse contacts 4 contacts the annular portion 5A of the vertical contact 5. Subsequent to the latter contact, the contact portion 4B of the transverse contacts 4 having been in contact with the annular portion 5A of the vertical contact 5 earlier is moved away from the annular portion 5A of the vertical contact 5. That is, the contact portions 4B of the transverse contacts 4 and the annular portion 5A of the vertical contact 5 never move out of contact with each other in the course of this operation. Thus, there occurs no detection state similar to that in which the control member 2 is returned to the neutral position N. This eliminates the possibility of erroneous detection.

Further, in the slide switch according to the present invention, the relative positional relationship in the sliding direction between the support member 3 and operation detecting mechanism C is not changed when the control member 2 is slid. Thus, when the control member 2 is pressed along the Z direction while maintaining the condition where the contact portions 4B of the transverse contacts 4 are in contact with the annular portion 5A of the vertical contact 5, this pressing operation can be electrically detected by the operation detecting mechanism C.

In particular, since the slide switch according to the present invention includes the posture maintaining mechanism A, the control member 2 placed over the support member 3 is moved in the Z direction in unison when the control member 2 is operated. During this movement, with the eight guide elements 3G formed peripherally of the supporting surface 3S fitted into the eight engageable portions 1G formed in the casing 1, the relative position between the casing 1 and support member 3 is not changed. As a result, the vertical parallel movement in the pressing direction can be realized without inclining the posture.

OTHER EMBODIMENTS

Figure 11:
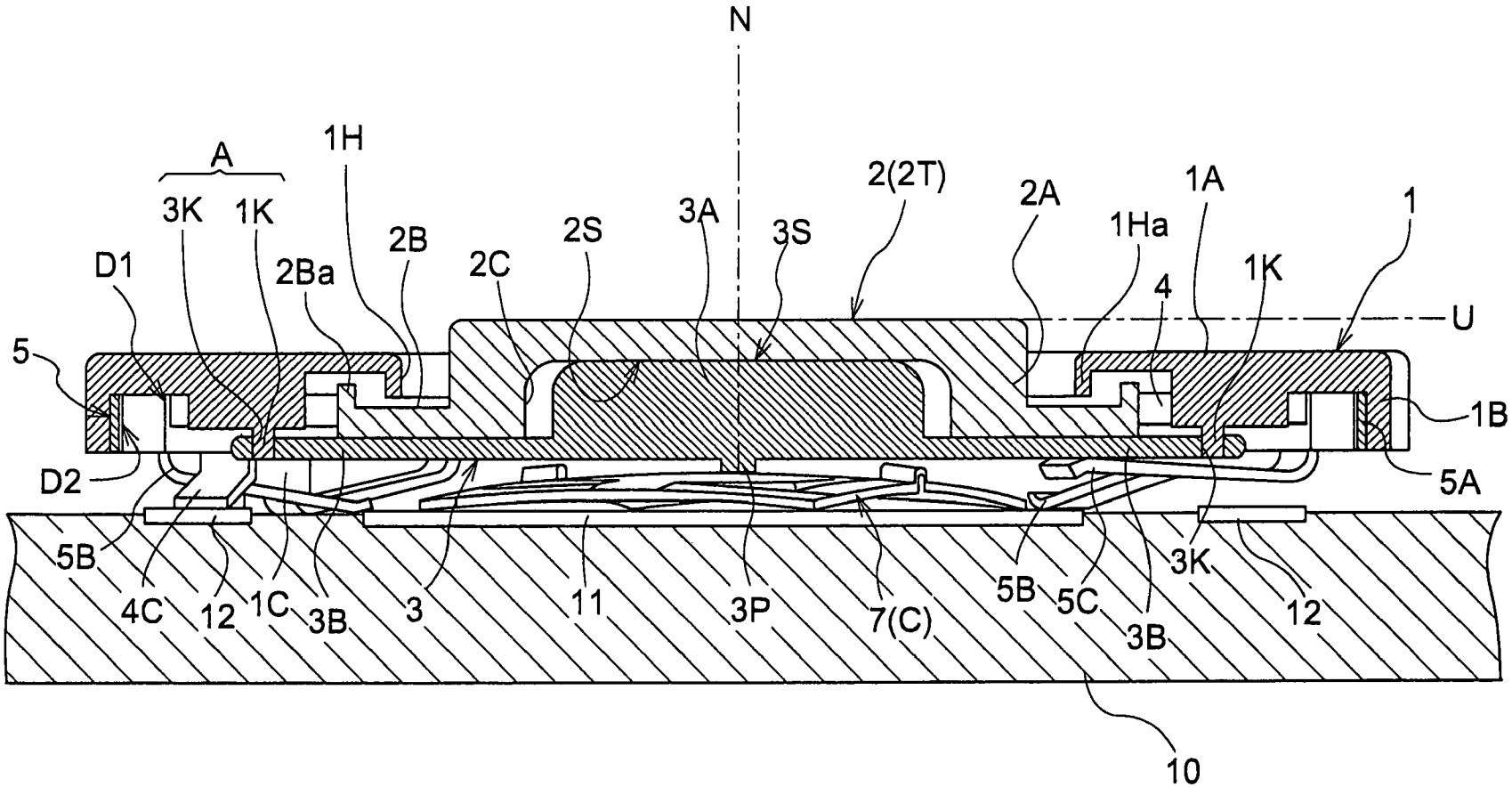
FIG. 11 is a sectional view of a slide switch in another embodiment.

The present invention is not limited to the above embodiment, but may be modified as follows:

(a) As shown in FIG. 11, the posture maintaining mechanism A may include a plurality of guide elements 1K formed on the bottom surface of the casing 1 to project downward, and a plurality of hole-like engageable portions 3K formed in the outer peripheries of a flange portion 3B of the support member 3 to be engageable with the guide elements 1K. With this construction, the vertical parallel movement in the pressing direction of the control member 2 placed over the support member 3 can be realized when the control member 2 is pressed, without inclining the posture thereof.

(b) It is possible to employ the construction including the plurality of recessed engageable portions 1G formed in the bottom surface of the casing 1 and the plurality of rod-shaped guide elements 3G formed on the outer peripheries of the flange portion 3B of the support member 3 as in the described embodiment, and further including the plurality of guide elements 1K formed on the bottom surface of the casing 1 to project downward and the plurality of hole-like engageable portions 3K formed in the outer peripheries of a flange portion 3B of the support member 3 to be engageable with the guide elements 1K as in the alternative embodiment (a). Such a combination of the construction of the embodiment and the construction of the alternative embodiment (a) can realize the vertical parallel movement in the pressing direction without inclining the posture.

(c) The engagement construction need not be employed as the posture maintaining mechanism A. For example, guide surfaces may be formed on the outer peripheries of the support member 3 along the Z direction while slidably contact portions may be formed on the bottom surface of the casing 1 to slidably contact the guide surfaces, or guide surfaces may be formed on the casing 1 in the Z direction while slidable contact portions may be formed on the support member 3 to slidably contact the guide surfaces.

What is claimed is:

1. A slide switch comprising:

a control member slidable in a direction along an imaginary plane and pressable in a direction perpendicular to the imaginary plane;

a plurality of transverse contacts arranged to surround the control member;

a vertical contact having a plurality of electrode portions associated with the plurality of transverse contacts to be conductive with any one of the transverse contacts when the control member is slid;

a support member for contacting a sliding surface formed on a surface facing away from a control surface of the control member, to allow sliding movement of the control member;

a casing for accommodating the support member and the control member to be movable in unison in the pressing direction; and a posture maintaining mechanism for maintaining a relative position between the control member and the casing when the control member and the casing are moved in the pressing direction, the posture maintaining mechanism being provided between the control member and the casing.

2. A slide switch as defined in claim 1, wherein:

the casing includes an opening formed in a central portion of a top surface thereof;

the control member has an integral construction including a control portion projecting upward from the opening and a flange portion formed peripherally of a bottom surface of the control member, the support member having a larger diameter than the flange portion, and the posture maintaining mechanism includes guide elements formed on outer peripheries of the support member to extend along the pressing direction, and engageable portions formed in the casing to be engageable with the guide elements, the engageable portions allowing sliding movement of the guide elements in the pressing direction.

3. A slide switch as defined in claim 2, wherein:

the vertical contact is arranged to have an annular conductor surrounding the plurality of transverse contacts, and a plurality of biasing pieces are provided to project from the vertical contact toward the bottom surface of the support member to act as a biasing mechanism for exerting a biasing force on the support member counter to the pressing direction.

4. A slide switch as defined in claim 3, wherein the vertical contact is supportably fitted into the bottom surface of the casing and includes conductive electrode portions extending downward from the vertical contact.

5. A slide switch as defined in claim 2, wherein the transverse contacts are supportably fitted into the bottom surface of the casing and include conductive electrode portions extending downward from the transverse contacts.

6. A slide switch as defined in claim 1, wherein:

the casing includes an opening formed in a central portion of a top surface thereof;

the control member has an integral construction including a control portion projecting upward from the opening and a flange portion formed peripherally of a bottom surface of the control member, the support member having a larger diameter than the flange portion; and the posture maintaining mechanism includes guide elements formed on the casing to extend along the pressing direction, and engageable portions formed in outer peripheries of the support member to be engageable with the guide elements, the guide elements allowing sliding movement of the engageable portions in the pressing direction.

7. A slide switch as defined in claim 6, wherein:

the vertical contact is arranged to have an annular conductor surrounding the plurality of transverse contacts; and a plurality of biasing pieces are provided projecting from the vertical contact toward a bottom surface of the support member to act as a biasing mechanism for exerting a biasing force on the support member counter to the pressing direction.

8. A slide switch as defined in claim 7, wherein the vertical contact is supportably fitted into the bottom surface of the casing and includes conductive electrode portions extending downward from the vertical contact.

9. A slide switch as defined in claim 6, wherein the transverse contacts are supportably fitted into the bottom surface of the casing and includes conductive electrode portions extending downward from the transverse contacts.

* * * * *